United States Patent [19]

Ludwig et al.

[11] Patent Number: 4,900,259

[45] Date of Patent: Feb. 13, 1990

[54] DUPLEX ELECTRICAL RECEPTACLE WITH ONE-PIECE MULTI-FUNCTION GROUNDING STRIP AND CHOICE OF GROUNDING WIRE TERMINATION

[75] Inventors: Melvin Ludwig, Great Neck; Neal Kluger, Rye, both of N.Y.

[73] Assignee: Eagle Electric Manufacturing Co., Inc., Long Island City, N.Y.

[21] Appl. No.: 318,847

[22] Filed: Mar. 6, 1989

[51] Int. Cl.[4] ..... H01R 13/652; H01R 4/38

[52] U.S. Cl. ..... 439/107; 439/801

[58] Field of Search ..... 439/92, 97, 101, 106, 439/107, 108, 650, 801

[56] References Cited

U.S. PATENT DOCUMENTS 4,836,793 6/1989 Munroe ..... 439/107

*Primary Examiner*—Gary F. Paumen

*Attorney, Agent, or Firm*—Kirschstein, Ottinger, Israel & Schiffmiller

[57] ABSTRACT

A dual mode grounding arrangement includes a one-piece, multi-function, grounding strip assembled within an electrical receptacle, and includes a screw terminal which is highly resistant to removal of a grounding screw from the strip. A grounding wire is connected to the screw terminal by either a wrap-around or a push-in wiring technique.

16 Claims, 2 Drawing Sheets

80
50
54
50a
20
64
62
10
18
50b
76
60
78
52
52a
68
66
41
52b
70
49
24
26
32
36
22
30
28
34
43
46
16
48
47
14
3
12
36
34
16
47
3
38
32
42
40
44
47
16
48
46
14
38
45
4
24
37
49
36
43
26
32
47
41
4
51
16

DUPLEX ELECTRICAL RECEPTACLE WITH ONE-PIECE MULTI-FUNCTION GROUNDING STRIP AND CHOICE OF GROUNDING WIRE TERMINATION

BACKGROUND OF THE INVENTION

1. Field of the Invention

This invention generally relates to a duplex electrical grounding receptacle and, more particularly, to a grounding arrangement assembled within the receptacle and enabling an installer to terminate, in either a wrap-around or push-in manner, a grounding wire to a one-piece, multi-function, grounding strip.

2. Description of Related Art

A conventional grounded duplex electrical receptacle had a pair of electrical outlets, each having two power sockets for receiving two power prongs of an electrical plug, and one grounding socket for receiving a grounding prong of the plug. The receptacle was conventionally installed in a wall-mounted electrical junction box to which two power wires and a ground wire were routed from a power supply. Each wire was connected to a respective screw mounted on the receptacle. Each screw was threaded into, and made electrical contact with, a respective electrically conductive strip located within the receptacle. Thus, a first power strip spanned the distance between, and interconnected, associated power sockets of both outlets; a second power strip spanned the distance between, and interconnected, other associated power sockets of both outlets; and a grounding strip spanned the distance between, and interconnected, associated grounding sockets of both outlets.

A conventional wall plate was mounted over the receptacle. The wall plate, which could be made of metal or plastic, had openings corresponding to the spacing and size of the electrical outlets so that the outlets remained exposed after the wall plate had been mounted over the receptacle. The exposed outlets enabled the three-pronged electrical plugs to be inserted into the corresponding sockets of the outlets.

As previously noted, a grounding screw was threaded into the grounding strip. The ground wire at the junction box was exposed at its end and wrapped at least partly underneath the head of the grounding screw to provide a reliable grounding for the receptacle. The grounding screw was subject to external forces, particularly during wiring of the receptacle, which forces tended to pull the grounding screw from its grounding strip. To prevent such removal, most grounding strips according to the prior art were typically made of a metal having a thickness of at least 0.030 in. and extruded to a 1/16 in. long cylinder in order to provide a minimum of two threads at 32 threads per inch, for engaging the grounding screw. Two threads were considered the minimum necessary to withstand expected removal forces when the screw was torqued down on the wire with a rotational force of 14 in.-lbs.

However, such thick grounding strips were undesirable in that the relatively large thickness dimension of the grounding strips contributed to high manufacturing costs. Also, they generally were made up of at least two parts: thick metal for the screw grounding terminal and thin metal for the female sockets. Also, fasteners were employed to reliably fasten the two parts.

Another problem with the known grounding strips was that they typically had to be held in position between upper and lower housing parts of the receptacle during assembly therewith. Experience showed that the grounding strip was sometimes shifted in position, thereby misaligning the strip and complicating the overall assembly procedure.

It was proposed in U.S. patent application Ser. No. 208,178, filed June 17, 1988, now Pat. No. 4,836,793 the entire contents of which are hereby incorporated herein by reference herein, and assigned to the same assignee as the instant application, to reduce the thickness of the grounding strip without compromising the ability of the grounding screw to reliably resist removal therefrom due to external forces. To that end, a thinner grounding strip with an integral screw terminal was proposed. The terminal included two spaced-apart grounding plates, each having a stamped-through single screw thread bounding a hole. A grounding screw was inserted through respective holes, and the single screw threads threadedly engaged the screw at spaced-apart locations to resist removal due to external forces.

Although the invention disclosed in said application was very satisfactory for the purpose, among others, of reducing the thickness of the grounding strip, only one type of grounding termination was available to an electrician. The grounding wire was wrapped around the shaft of the grounding screw and clamped by the screw head against the strip to complete the grounding connection. This wrap-around installation technique, however, has proved to be somewhat labor-intensive and time-consuming, particularly when a multitude of electrical receptacles were required to be wired. It would be desirable to present the electrician with the option of terminating a grounding wire to the grounding strip in a manner other than the aforementioned wrap-around technique.

SUMMARY OF THE INVENTION

1. Objects of the Invention

It is a general object of this invention to present the electrician with the option of connecting a grounding wire to a grounding strip utilizing either the wrap-around wiring technique or a push-in wiring technique.

Another object of this invention is to reduce the thickness of a grounding strip without compromising the ability of the grounding screw to reliably resist removal therefrom due to external forces.

It is another object of this invention to reduce the manufacturing costs of grounding strips.

A further object of this invention is to facilitate automatic assembly of the grounding strip within the receptacle.

Still another object of this invention is to provide multiple grounding functions in a one-piece grounding strip, thereby eliminating any connecting interfaces and their inherent resistances resulting from a multi-partite construction.

2. Features of the Invention

In keeping with these objects, and others which will become apparent hereinafter, one feature of this invention resides, briefly stated, in a dual-mode grounding arrangement for assembly within an electrical receptacle of the type mounted in a junction box and covered by a wall plate.

The arrangement includes a one-piece, multifunction, grounding strip having wiper means integral with the strip, and operative for wipingly contacting a ground prong of an electrical plug to be plugged into the receptacle. Advantageously, the wiper means includes a pair of grounding contacts struck out of the strip, and bounding an opening through which the ground prong is inserted in electromechanical wiping contact with the grounding contacts. Each grounding contact is formed with a centrally-located, upwardly-open slot to form a pair of contact faces for each grounding contact. A pair of support ribs is provided on the receptacle, each rib supportably engaging a respective grounding contact in order to reliably resist distortion of the same upon insertion of the ground prong.

The strip also comprises box fastener contact means integral with the strip, and operative for contacting a box fastener, e.g. a threaded screw, employed for mounting the receptacle in the junction box. When the box and its fastener are made of conductive material, the box fastener contact means advantageously grounds the box to the grounding strip.

The strip further comprises wall plate fastener means integral with the strip, and operative for supportably engaging a wall plate fastener operative for mounting the wall plate over the receptacle. The wall plate fastener means is advantageously constituted by a stamped-through single screw thread which threadedly engages a threaded wall plate fastener. When the wall plate and its fastener are constituted of an electrically conductive material, the wall plate fastener means advantageously grounds the wall plate to the grounding strip.

The strip yet further comprises means integral therewith for holding the strip at a predetermined position within the receptacle during assembly. Advantageously, the holding means includes a support post on the receptacle and extending through an aperture formed through the strip. The aperture is bounded by resilient walls which supportably engage the support post. This feature automatically holds the strip in place within the receptacle and facilitates automatic assembly.

In further accordance with this invention, screw terminal means integral with the strip is provided for electrically grounding the same. A pair of spaced-apart electrically conductive grounding plates, each having a slot, are formed on the strip. The slot on one plate is juxtaposed with the slot on the other plate. A grounding screw has a head and a threaded shaft which is received, and extends with clearance, through the juxtaposed slots. A nut having a plurality of threads threadedly engages the screw shaft to resist axially-directed forces tending to pull the grounding screw from the strip.

Advantageously, an electrically insulating, generally planar, spacer integral with the receptacle is assembled between the grounding plates for engagement therewith. The resultant combination of two grounding plates with the spacer sandwiched therebetween, all in mutual contact, renders the screw terminal means highly resistant to removal of the grounding screw. This is accomplished without having to form the strip with a relatively large thickness dimension to accommodate multiple screw threads for threadedly engaging the grounding screw. The nut itself provides the multiple screw threads and, in a preferred embodiment, measures about 1/16 in. in thickness so that there will be no difficulty in passing the 14 in.-lbs. screw tightening torque test observed by this industry. The strip has a thickness dimension on the order of 0.015 in., thereby greatly reducing manufacturing costs.

Biasing means are provided to present an electrician with a choice of how to connect a grounding wire to the grounding strip. In a first, wrap-around, grounding position, the grounding wire is wrapped at least partly around the screw shaft and clamped between the screw head and one of the grounding plates. The biasing means is a spring, preferably integrally molded with the receptacle, and is positioned to resiliently bear against the nut and constantly push the same against the other grounding plate. The pushing of the spring on the nut also automatically positions the screw head in a remote condition away from the grounding plates so that sufficient room exists for an exposed end of the grounding wire to be looped around the screw shaft. Upon subsequent turning of the screw, the head will push the wire against said one grounding plate and insure a firm, electromechanical clamping contact between the wire and the strip.

The receptacle also includes a passage through which an exposed end of the grounding wire is insertable. In the first grounding position, the passage is at least partly blocked by the nut. However, if the electrician pushed on the screw head in the remote condition against the restoring force of the spring, the nut would eventually clear the passage, thereby allowing the wire to be inserted through the passage and be located between the nut and the other grounding plate inside the receptacle. In this second, push-in, grounding position, the spring resiliently clamps the exposed wire end between the nut and the other grounding plate, thus insuring a firm, electromechanical clamping connection. The screw is then threaded fully into the nut to a close-in position adjacent the housing to complete the connection. The push-in wiring technique is generally regarded as being less time-consuming than the aforementioned wrap-around technique.

Still another feature of this invention resides in providing an electrically insulating support element extending into the juxtaposed slots and bosses extending into the spacing between the grounding plates and supporting the same from opposite sides thereof. The support element and bosses serve to reinforce the screw terminal means to resist forces tending to remove the grounding screw therefrom.

Not only is the dual grounding mode grounding arrangement, per se, novel, but this invention is also intended to cover an improved electrical receptacle in which such a grounding arrangement is assembled.

The novel features which are considered as characteristic of the invention are set forth in particular in the appended claims. The invention itself, however, both as to its construction and its method of operation, together with additional objects and advantages thereof, best will be understood from the following description of specific embodiments when read in connection with the accompanying drawings.

DETAILED DESCRIPTION OF THE PREFERRED EMBODIMENT

Figures 1, 2, 3, 4:
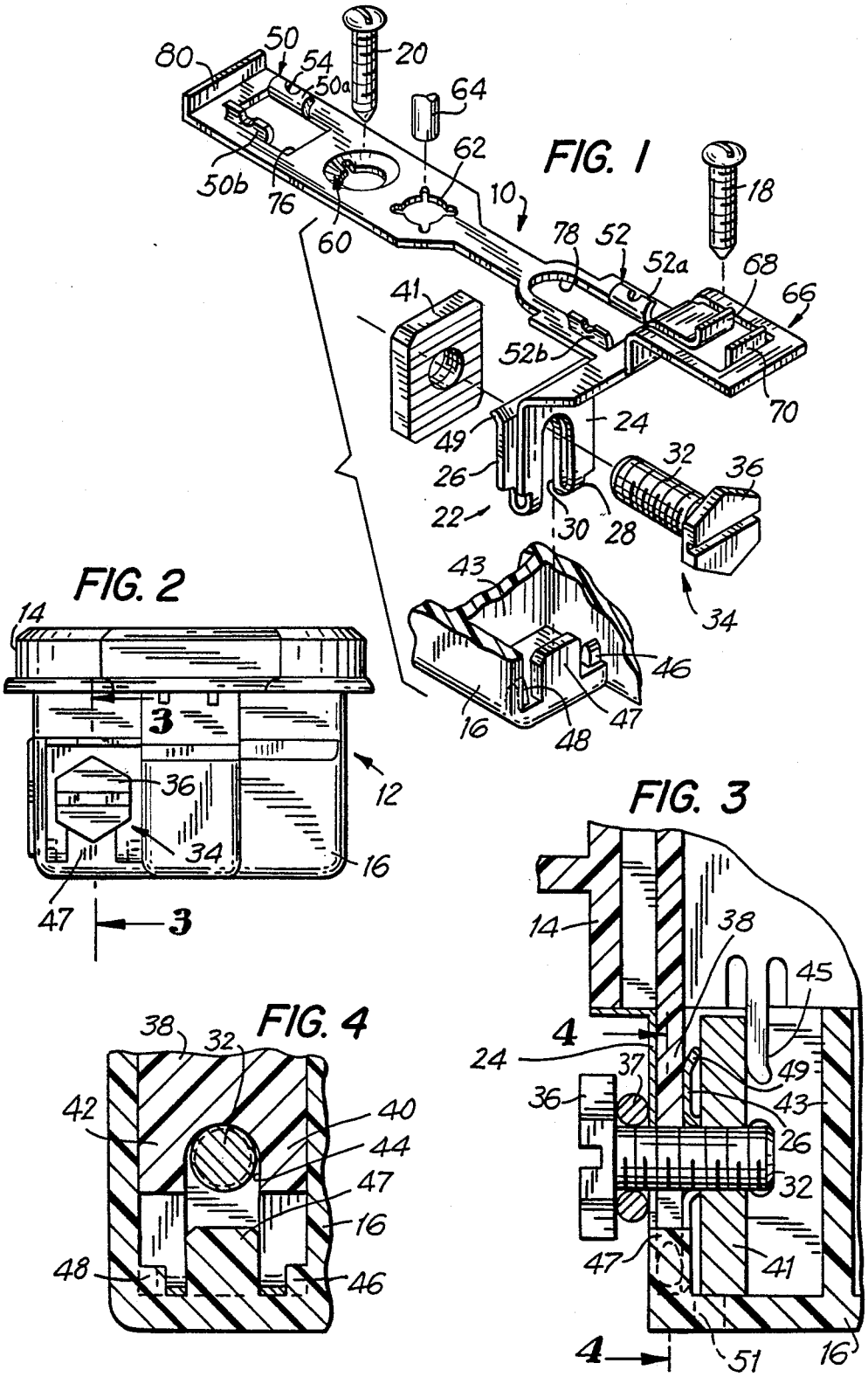
FIG. 1 is an exploded, front perspective view of a grounding arrangement including a grounding strip, a grounding screw and a nut, and a broken-away perspective view of a lower housing part of a receptacle into which the strip, screw and nut are received, as well as fasteners for use with the strip.
FIG. 2 is an end elevational view of an assembled receptacle showing a screw terminal.
FIG. 3 is an enlarged, broken-away sectional view of the grounding arrangement as taken along line 3—3 of FIG. 2 with a grounding wire attached in a wraparound mode to the grounding screw.
FIG. 4 is a broken-away sectional view as taken along line 4—4 of FIG. 3.
Figure 5:
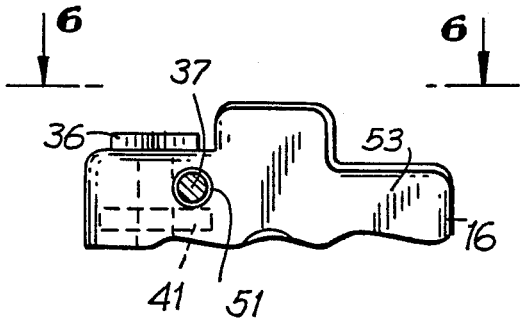
FIG. 5 is a broken-away bottom plan view showing the underside of the receptacle with the ground wire attached in a push-in mode to the grounding screw.
Figure 6:
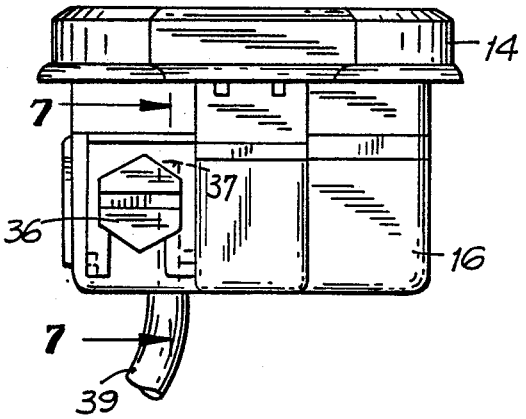
FIG. 6 is an end view taken on line 6—6 of FIG. 5.
Figure 7:
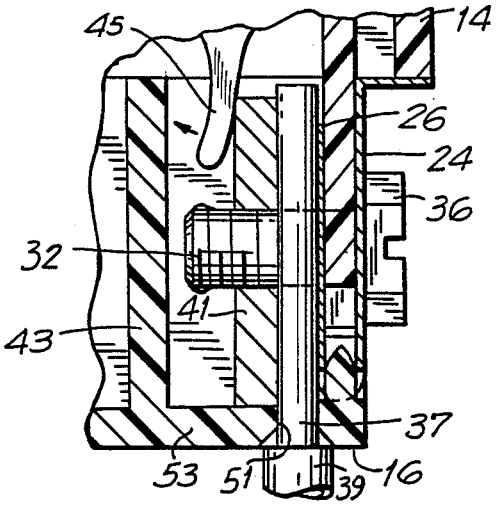
FIG. 7 is an enlarged section view taken on line 7—7 of FIG. 6, and analogous to FIG. 3.

Turning now to the drawings, reference numeral 8 generally identifies a dual grounding mode grounding arrangement assembled within a duplex electrical receptacle 12 (see FIG. 2) having an upper housing part 14 and a lower housing part 16, both housing parts being constituted of an electrically insulating, e.g. plastic, material. A pair of box fastener screws 18, only one of which is shown in FIG. 1, are employed to mount the receptacle on a non-illustrated conventional junction box. A wall plate fastener screw 20, shown in FIG. 1, is employed to mount a conventional non-illustrated wall plate over the junction box. The receptacle 12 and its components are of conventional construction, except as specifically noted below. Hence, a detailed discussion of the receptacle 12, its sockets and power strips has not been provided, except to the extent that such features relate to the instant invention.

Referring now to FIG. 1, the grounding arrangement includes a one-piece, multi-function, grounding strip 10 constituted of a metallic material, e.g. a copper alloy, and having a thickness on the order of 0.015 in. It will be recalled that most conventional grounding terminals, by contrast, each had a thickness on the order of 0.031 in. minimum in order to provide sufficient "meat" so that a minimum of two threads could be formed on the strip in order to threadedly engage a grounding screw. Also, the grounding strip of said application required a 0.031 in. thick material to be extruded to a total length of 0.062 in. so as to provide a minimum of two full threads, necessary to resist 14 in.-lbs. of torque without stripping.

The strip 10 of this invention is initially a flat, planar sheet from which various portions are cut, bent, stamped and otherwise deformed to form the various grounding functions required to be performed. Strip 10 includes a screw terminal portion 22 including two spaced-apart grounding plates 24, 26, each being formed with respective arms bounding a single downwardly-open slot 28 or 30. The slots 28, 30 on both plates are juxtaposed and arranged along an axis for receiving the threaded shaft 32 of a grounding screw 34 having a screw head 36 under which the exposed end 37 of a grounding wire 39 is captured in a first, wraparound mode of connecting the wire to the strip. A nut 41, symmetrical in both directions and staked to the screw to facilitate automatic assembly, has a threaded center hole with a plurality of threads operative for threadedly engaging the threaded shaft 32. The thickness of the nut is at least sufficient for two threads to engage the shaft. An inner face of the nut 41 is provided with a plurality of coined serrations for affirmatively engaging the exposed end 37 of the grounding wire 39 as described in detail hereinafter.

As shown in FIG. 3, the upper housing part 14 has a generally planar spacer or tab 38 integral therewith and extending downwardly therefrom toward the lower housing part 16. As shown in FIG. 4, the tab 38 has two arms 40, 42 bounding a downwardly-open U-shaped cutout 44 juxtaposed with slots 28, 30. Upon assembly, the tab 38 is situated in the spacing between the plates 24, 26; the arms 40, 42 and the arms bounding slots 28, 30 straddle the screw 34; and the cutout 44 and the slots 28, 30 at least partially receive the threaded shaft 32. The tab engages in surface-to-surface contact with both interior surfaces of the plates 24, 26 which face each other. The resultant combination of the plates 24, 26 sandwiching the tab 38, and the threading of the screw shaft into at least two full threads of the nut 41, cause the screw terminal to be highly resistant to exterior forces tending to remove the grounding screw 34 from the strip 10.

In order to further reinforce the screw terminal 22, a pair of bosses 46, 48 are formed integral with the lower housing part 16. The bosses 46, 48 project upwardly into the spacing between the plates 24, 26 at lower regions thereof.

A central support element 47 is formed integral with the lower housing part 16 and projects upwardly into the downwardly-open slots 28, 30 and cutout 44. The support element and the bosses prevent the plates 24, 26 from being bent away from the lower housing part 16, should a bending force be transmitted from the grounding wire when the complete receptacle is assembled to the wall junction box.

As best shown in FIG. 3, the lower housing part 16 has a partition 43 bounding an interior wiring compartment in which inner grounding plate 26 is situated. A spring 45 extends into this wiring compartment and is preferably integrally molded with, and extends downwardly of, the top housing part 14. The spring 45 is a cantilever-type projection or finger which is capable of at least slightly yielding to external pressure and of automatically returning to its initial position when such external pressure is relieved. The spring 45 has a flat surface which resiliently bears against the nut 41, and constantly urges the nut 41 against the inner grounding plate 26. The nut is held firmly in position within the wiring compartment.

The spring 45 also serves to position the screw head 36 away from the outer grounding plate 24. The electrician, thus, has sufficient room between the head 36 and the outer grounding plate 24 to loop the exposed wire end 37 at least partly about shaft 32. To insure a firm, electromechanical grounding connection, the screw is subsequently turned so that the head 36 tightly clamps the exposed wire end 37 between the head 36 and the outer plate 24.

Should the electrician not wish to connect the grounding wire by the aforementioned wrap-around technique, but, instead, avail himself of a push-in wiring technique, a passage 51 is pre-formed in and through a bottom wall 53 of the lower housing part 16. The passage is large enough to receive with clearance the exposed wire end 37. However, the nut 41 at least partly overlies and blocks the passage 51 in the first grounding position. Hence, it is necessary to move the nut 41 out of the way to permit insertion of the wire end 37 into the wiring compartment.

For this purpose, the electrician need only push on the screw head 36 which, as previously noted, is initially located away from the outer grounding plate 24.

This pushing movement urges the nut 41 against the spring 45, and rearwardly moves the spring and the nut.

Since the lower part of the nut no longer blocks the passage 51, the wire end 37 is fully inserted between the nut 41 and the inner plate 26 and is clamped therebetween when the electrician releases the pressure exerted on the screw head. The spring 45 constantly exerts pressure against the wire end at one side, while the flared portion of inner plate 26 constantly exerts pressure against the wire end at the opposite side of the wire end. The screw may now be fully threaded into the nut so as to complete and insure a firm, electromechanical grounding connection.

Returning to FIG. 1, the strip 10 also includes wiper means 50, 52, one for each outlet on the receptacle. The wiper means 50, 52 are integral with the strip 10, and wipingly contact a respective ground prong of an electrical plug to be plugged into a respective outlet. Each wiper means includes a pair of grounding contacts 50*a*, 50*b*, 52*a*, 52*b*, struck out of the strip 10 and extending upwardly therefrom. Each said contact has a curved cross-section which extends upwardly toward the grounding socket formed in each outlet. The grounding contacts 50, 52 respectively bound openings 76, 78 through which the ground plugs are respectively inserted in electromechanical wiping contact. Openings 76, 78 extend slightly past the respective pairs of contacts so that each contact pair can flex apart slightly. Each grounding contact is centrally formed with an upwardly open notch, e.g. notch 54, whose closed end is generally V-shaped. Opposing ribs in the top housing back up the pair of contacts and the notch 54 is necessary to clear these ribs. The ground prong inserted between the grounding contacts 50*a*, 50*b* is thus engaged by two separate contact faces opposing each other in order to provide for a very reliable grounding of the prong with the strip 10, and the back-up ribs make it impossible to destroy the contact integrity by pulling the male plug out by the wire at a severe angle.

Another feature of this invention resides in wall plate fastener means 60 constituting a stamped-through single screw thread of the tineman type. The thread 60, as best shown in FIG. 1, threadedly engages the wall plate threaded fastener 20, and serves to reliably mount the wall plate over the receptacle. If the wall plate is made of metal, then the wall plate is reliably grounded to the strip 10.

Another feature of this invention resides in providing means 62 integral with the strip for holding the same at a predetermined fixed position within the receptacle during assembly. The holding means 62 includes resilient walls bounding an aperture having radially outwardly-extending slits which, in FIG. 1, resemble a star-shaped pattern. The resilient walls serve to resiliently and supportably engage a locating post 64 integral with the upper housing part 14 of the receptacle. The support post 64 extends through, and is frictionally retained in, the aperture of holding means 62. This feature facilitates automatic assembly of the receptacle and effectively resists any tendency on the part of the strip 10 to shift during assembly.

Still another function performed by the strip is the grounding of the box fastener screws 18 operative for mounting the receptacle to a junction box. For that purpose, box fastener contact means 66 are formed integral with the strip, and include a pair of resilient contact surfaces or fingers 68, 70. The fingers 68, 70 are struck out of the strip and bound an opening through which the box fastener 18 is inserted. If the outlet box is made of metal, then the mere mounting of the box screw 18 automatically grounds the outlet box when the receptacle is mounted therein.

In the preferred embodiment of this invention, the strip 10 is constituted of a copper alloy having a thickness dimension on the order of 0.015 in., in which case, the tab 38 has a thickness on the order of 0.045 in. The screw and nut threads correspond to No. 8-32 screw threads for the terminal screw 34 and nut 41,and No. 6-32 screw threads are used for the wall plate screw 20.

A vertical tab 80 is provided at the end of the strip to facilitate automatic feeding into an assembly machine.

It will be understood that each of the elements described above, or two or more together, also may find a useful application in other types of constructions differing from the types described above.

While the invention has been illustrated and described as embodied in a duplex electrical receptacle with one-piece multi-function grounding strip and choice of grounding wire termination, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

1. A dual mode grounding arrangement assembled within an electrical receptacle of the type mounted in a junction box and covered by a wall plate, said arrangement comprising:

(A) a one-piece, multi-function, grounding strip including
  (a) a wiper means integral with the strip, for wipingly contacting ground prong of an electrical plug to be plugged into the receptacle,
  (b) box fastener contact means integral with the strip, for contacting a box fastener operative for mounting the receptacle in the junction box,
  (c) wall plate fastener means integral with the strip, for supportably engaging a wall plate fastener operative for mounting the wall plate over the receptacle,
  (d) means integral with the strip, for holding the strip at a predetermined position within the receptacle during assembly, and
  (e) screw terminal means integral with the strip, for electrically grounding the strip, including a pair of spaced-apart electrically conductive grounding plates having juxtaposed slots;

(B) a grounding screw having a head and a threaded shaft extending with clearance through and past the juxtaposed slots;

(C) a nut having a plurality of threads for threadedly engaging the shaft of the grounding screw to resist axially directed forces tending to pull the grounding screw from the strip; and (D) biasing means for urging the screw and the nut to a selected one of a first, wrap-around, grounding position in which a grounding wire is wrapped about the screw shaft and clamped between the screw head and one of the grounding plates, and a second, push-in, grounding position in which the grounding wire is clamped between the nut and the other of the grounding plates.

2. The grounding arrangement as recited in claim 1, wherein the biasing means includes a spring resiliently bearing against the nut and constantly pushing the nut against the other grounding plate in the first grounding position.

3. The grounding arrangement as recited in claim 1, wherein the biasing means includes a spring resiliently bearing against the nut and constantly pushing the grounding wire against the other grounding plate in the second grounding position.

4. The grounding arrangement as recited in claim 1, wherein the receptacle has a passage at least partially blocked by the nut in the first grounding position, and wherein the biasing means yields to allow the nut to clear the passage and permit insertion of the grounding wire through the passage in the second grounding position.

5. The grounding arrangement as recited in claim 4, wherein the biasing means is a spring of one piece with the receptacle.

6. The grounding arrangement as recited in claim 1; and further comprising an electrically insulating, generally planar, support element on the receptacle and extending into the juxtaposed slots.

7. The grounding arrangement as recited in claim 1; and further comprising electrically insulating bosses extending into and supporting the grounding plates from opposite sides thereof.

8. The grounding arrangement as recited in claim 1, wherein the strip is constituted of an electrically conductive metallic material having a thickness dimension on the order of 1/64 of an inch, and wherein each grounding plate has said same thickness dimension as the strip.

9. The grounding arrangement as recited in claim 1, wherein said wiper means includes a pair of grounding contacts struck out of the strip and extending upwardly therefrom, said grounding contacts bounding an opening through which the ground prong is inserted in electromechanical wiping contact with the grounding contacts.

10. The grounding arrangement as recited in claim 1, wherein said box fastener contact means includes a pair of resilient contact surfaces struck out of the strip and bounding an opening through which the box fastener is inserted.

11. The grounding arrangement as recited in claim 1, wherein said wall plate fastener means includes a stamped-through single screw thread for threadedly engaging the wall plate fastener.

12. The grounding arrangement as recited in claim 1, wherein the holding means includes resilient walls bounding an aperture having radially outwardly-extending slits, said resilient walls resiliently and supportably engaging a locating post on the receptacle, said locating post extending through the aperture.

13. An improved electrical receptacle of the type mounted in a junction box and covered by a wall plate, comprising:

(A) a housing having upper and lower parts;

(B) a one-piece, multi-function, grounding strip assembled within the receptacle between the housing parts, said grounding strip including (i) prong wiper means integral with the strip, for wipingly contacting a ground prong of an electrical plug to be plugged into the receptacle, (ii) box fastener contact means integral with the strip, for contacting a box fastener operative for mounting the receptacle in the junction box, (iii) wall plate fastener means integral with the strip, for supportably engaging a wall plate fastener operative for mounting the wall plate over the receptacle, (iv) means integral with the strip, for holding the strip at a predetermined position within the receptacle during assembly, and (v) screw terminal means integral with the strip, for electrically grounding the strip, including a pair of spaced-apart electrically conductive grounding plates having juxtaposed slots;

(C) a grounding screw having a head and a threaded shaft extending with clearance through the juxtaposed slots;

(D) a nut having a plurality of threads for threadedly engaging the screw shaft to resist axially-directed forces tending to pull the grounding screw from the strip; and (E) biasing means for urging the screw and the nut to a selected one of a first, wrap-around, grounding position in which a grounding wire is wrapped about the screw shaft and clamped between the screw head and one of the grounding plates., and a second, push-in,grounding position in which the grounding wire is clamped between the nut and the other of the grounding plates.

14. The receptacle as recited in claim 13, wherein the biasing means includes a spring resiliently bearing against the nut and constantly pushing the nut against the other grounding plate in the first grounding position.

15. The receptacle as recited in claim 13, wherein the biasing means includes a spring resiliently bearing against the nut and constantly pushing the grounding wire against the other grounding plate in the second grounding position until the screw is tightened.

16. The receptacle as recited in claim 13, wherein the receptacle has a passage at least partially blocked by the nut in the first grounding position, and wherein the biasing means yields to allow the nut to clear the passage and permit insertion of the grounding wire through the passage in the second grounding position.

* * * * *